United States Patent [19]

Von Hoffman

[11] Patent Number: 5,058,949

[45] Date of Patent: Oct. 22, 1991

[54] FOLDABLE BEACH CHAIR

[76] Inventor: Brant Von Hoffman, 352 Huntley Dr., Los Angeles, Calif. 90048

[21] Appl. No.: 568,973

[22] Filed: Aug. 17, 1990

[51] Int. Cl.[5] ..... A47C 4/28; B60W 2/02

[52] U.S. Cl. ..... 297/45; 297/379; 297/378

[58] Field of Search ..... 297/45, 46, 47, 48, 297/56, 31, 378, 379; 16/360

[56] References Cited

U.S. PATENT DOCUMENTS

| | | | |
|---|---|---|---|
| 3,971,592 | 7/1976 | Farley | 297/217 |
| 4,369,987 | 1/1983 | Witherell | 297/45 |
| 4,592,570 | 6/1986 | Nossiri | 297/379 |
| 4,775,182 | 10/1988 | von Hoffman | 297/45 |
| 4,889,383 | 12/1989 | Jones | 297/45 |

*Primary Examiner*—Laurie K. Cranmer
*Assistant Examiner*—Cassandro Hope
*Attorney, Agent, or Firm*—Martha G. Pugh

[57] ABSTRACT

A foldable chair for the beach or outdoor use comprising a frame of metal or other rigid material including fabric or plastic seat and back rests is supported between pairs of elongated telescoping parallel supporting members including X-pivoted braces which are hingedly connected to enable the chair to be folded together into an elongated configuration for carrying purposes. A locking mechanism enables the chair to be maintained in rigid open position.

3 Claims, 4 Drawing Sheets

FOLDABLE BEACH CHAIR

This relates in general to foldable or collapsible chairs, more particularly, foldable beach chairs which can be locked into a rigid open position, and can be collapsed into a folded configuration of limited width for carrying.

The object of this invention is improvement of the foldable beach chair disclosed and claimed in my U.S. Pat. No. 4,775,182 issued Oct. 4, 1988, which is incorporated herein by reference. More particular objects are to provide a chair which is more rigid and locked into position and mounted further off of the sand or other support surface, than the chair of my earlier invention.

My earlier patent discloses a beach chair which comprises a foldable frame of metal or other rigid material comprising a fabric or plastic seat rest supported between a pair of tubes or rods, to the ends of which are hingedly connected a pair of telescoping back supports which are interconnected by a pair of X-pivoted braces, and a lower pivoted brace. This arrangement enables the chair to be folded into an extended, elongated configuration of limited width for carrying.

In the improved version in accordance with the present invention, the seat is supported by a pair of telescoping trombone-shaped supports which are interconnected in the plane of the seat by a second pair of X-pivoted braces similar to those used on the chair back. The chair is locked in open upright position by a pair of bosses or detents connected to the lower ends of the back supports which snap into openings in the slidable members of the telescoping seat supports on opposite sides of the seat. When the back support members are rotated forward towards the seat, the bosses are pulled out of the openings, releasing the telescoping seat supports to become elongated. Simultaneously, the back and seat supports are elongated telescopically, and the pivoted braces in the back and seat are folded together to form an elongated configuration of limited width convenient for carrying.

This embodiment has the advantage over the earlier model of providing a more rigid seat which is raised up above the sand or other surface, and which is rigidly locked into its open position, but is readily disengaged for folding into its carrying configuration.

Other objects, features and advantages will be realized by a study of the detailed description hereinafter with reference to the attached drawings.

SHORT DESCRIPTION OF THE DRAWINGS

DETAILED DESCRIPTION OF THE INVENTION

Figure 1:
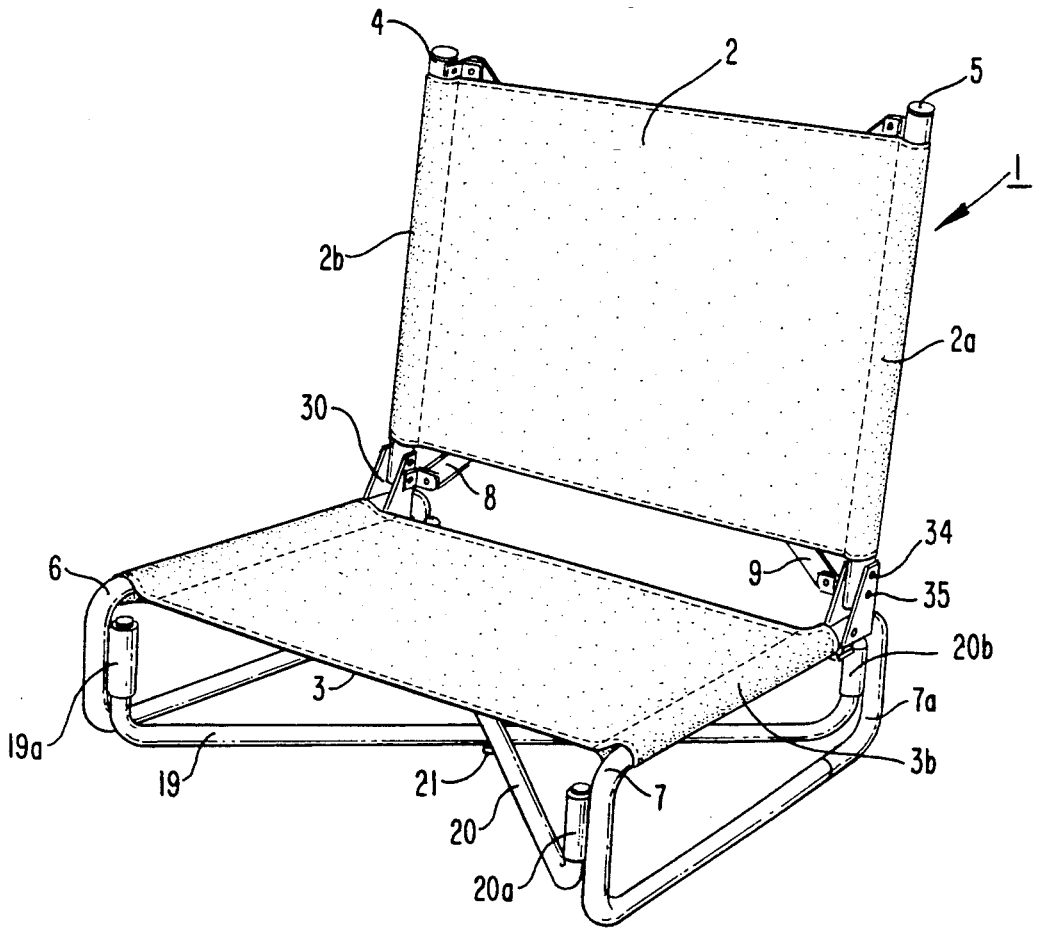
FIG. 1 is a front perspective showing of the folding chair of my invention in open position, set up for use.

Referring to FIG. 1 of the drawings, the beach chair 1, of my invention, is shown set up for use. This chair is an improvement of the chair disclosed and claimed in my U.S. Pat. No. 4,755,182 issued Oct. 4, 1988, which is incorporated herein by reference.

The chair 1 comprises a back-rest comprising cover 2 which is mounted on a frame supported in pivotal relation to a seat comprising cover 3. The covers 2 and 3, which may be of fabric such as, canvas or plastic or any similar material conventionally used for out-of-doors type furniture, are mounted on a frame of aluminum, or any other rigid lightweight material having sufficient tensile strength to support the weight of an average adult in sitting position, or to withstand the rigors of folding and unfolding.

In the present example, the back rest cover 2 is 23 inches across and 13½ inches from top to bottom and is hemmed at opposite lateral edges to provide a pair of sleeves 2*a* and 2*b* which have inner diameters just sufficient to accommodate a pair of telescoping tubular back supports 4*b* and 5*b*, which are part of the supporting frame. In the present example, the tubular back supports 4*b* and 5*b* are each, say, 1 inch in outer diameter.

The telescoping tubular back supports 4 and 5 each comprise a cylindrical upper terminal portion, say, 1 inch in outer diameter, which extend, say, 3 inches, in an axial direction. Projecting downward and inward from the tops of 4 and 5 are tubular members 4*a* and 5*a*, which in the present embodiment are about 18 inches long and just less than ⅞ inch in outer diameter. These fit telescopically into the corresponding metal sleeves 4*b*, 5*b*, on each side, each comprising a tube, say, one inch in outer diameter, ⅞ inch in inner diameter, and 18 inches long.

The inner ends of the sleeves 4*b*, 5*b* are rigidly fastened between the prongs of the respective identical U-shaped metal shoes 30, 31, comprising parallel plates 30*a*, 30*b* and 31*a*, 31*b* so that when the tubular sleeves 4*b*, 5*b* are disposed in fully open, upright position, they form an angle slightly greater than 90 degrees with the horizontally-disposed seat 2. The shoes 30, 31 will be more fully described hereinafter.

The seat cover 3, which in the present example is rectangular is, say, 15 inches from front to back, and 23 inches across the width, having a pair of sleeves on its opposite lateral edges which accommodate the upper tubular rungs of seat supports 6 and 7 which are 1 inch in outer diameter. The seat supports 6 and 7 which are spaced, say, 17 inches apart in edgewise relation, are shaped like a pair of parallel slide-trombones, extending, say, 16 inches overall from front to back in closed position, and, standing, say, 6 inches from top to bottom on the supporting surface.

Figure 2:
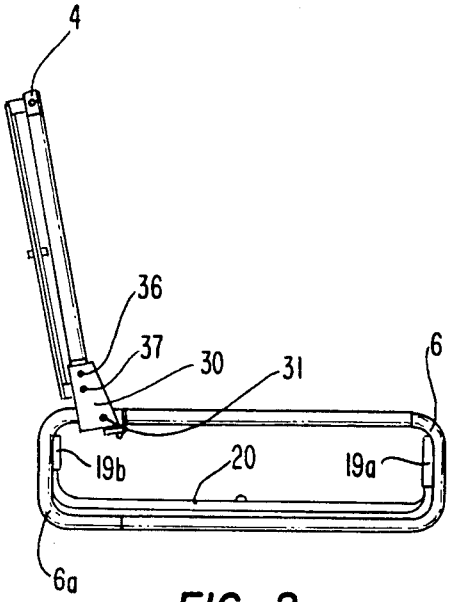
FIG. 2 is a side elevational showing of the folding chair of my invention, with the fabric removed, showing the frame in open position.

The elongated elipitical seat supports each comprise a pair of C-shaped elements 6 and 7 in telescoping reaction, which are of tubular construction, 1 inch in outer diameter and $\frac{7}{8}$ inch in inner diameter, the closed ends of the C being at the front end of the open chair, and the legs of the C extending inwardly towards the matching C-shaped elements 6*a* and 7*a*, having their closed ends at the rear, and the legs extending inwardly. The legs of C-shaped members 6, 6*a* are slideably mounted edgewise in trombone fashion on the tubular members 6*c* and 6*b*; and the legs of the C-shaped members 7, 7*a* are slidably mounted spaced apart from 6, 6*a*, on the tubular members of 7*c* and 7*b*. When the chair is set up in completely open position, the inner ends of 6 and 6*a*, and of 7 and 7*a*, are telescopically closed together in flush relation as shown in FIG. 2, the trombone-shaped composites being spaced apart edgewise, and supporting the seat 3 in taut relation between them.

Figure 9B:
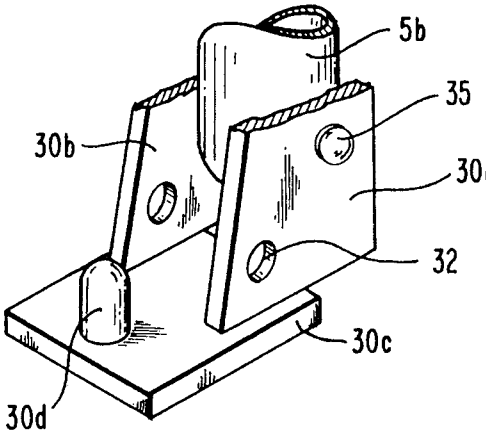
FIG. 9 is an enlarged showing of a fragment of the chair of my invention with the back frame in upright position, and the telescoping support members held in extended position by a locking means comprising a boss interposed into an opening in one of the upper seat support members.
FIG. 9A is an enlarged perspective showing of the locking means of FIG. 9.
Figure 9A:
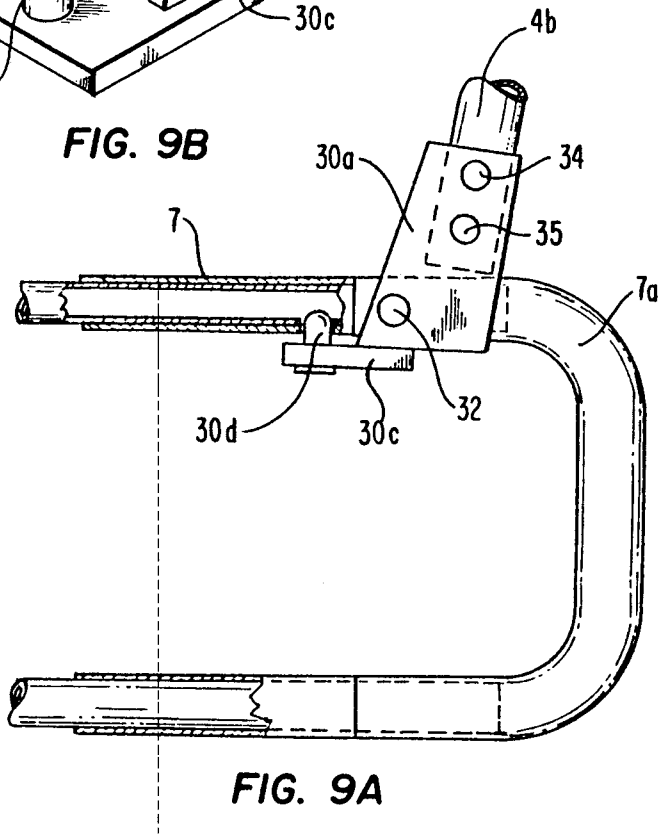

Important features of the presesnt invention are the U-shaped shoes 30 and 31 (FIG. 1 and 2) which anchor the lower ends of sleeves 4*b* and 5*b* of back frame members 4 and 5 to the back rear portions of the seat support members 6*a* and 7*a*, about an inch from their rear ends. The U-shaped shoes 30 and 31 each comprise a pair of frusto-triangular metal plates, 30*a*, 30*b* and 31*a*, 31*b*, say $\frac{1}{8}$ inch thick, spaced apart about an inch, with their major surfaces in parallel relation. The plates 30*a*, 30*b* and 31*a*, 31*b* comprising shoes 30 and 31, are each, say, two inches wide across the bottom, one inch wide across the top, and say, $2\frac{1}{2}$ inches high. The shoe 30 comprising plates 30*a* and 30*b* is fastened rigidly in place on the bottom end of the sleeve 4*b* by bolts 36 and 37. The bottom edges of 30*a* and 30*b* abut and are fastened to a foot plate 30*c*, shown in FIG. 9A which serves to fasten the plates 30*a* and 30*b* together at the bottom. The bottom edges of plates 31*a* and 31*b* abut a similar foot plate 31*c* which serves to fasten them together.

The shoe members 30 and 31 are mounted rotatably on the upper rungs of the tubular members 6*a* and 7*a*, respectively, so that the upper legs of the C-shaped tubular members 6*a* and 7*a* pass through the respective openings between the lower ends of the sleeves 4*b* and 5*b*, and the upper surfaces of the feet 30*c* and 31*c*. Pivots 32 and 33, respectively, pass through plates 30*a* and 30*b*, and 31*a* and 31*b*, and the respective lateral walls of 6*a* and 6*b*, so that the shoes 30 and 31 respectively enclosing the tubular back support sleeves 4*b* and 5*b* rotate from an upright position when the backrest 2 is fully open, to a forward position in which the sleeves 4*b* and 5*b* approach a parallel relation to seat support members 6*a* and 7*a*.

Figure 10:
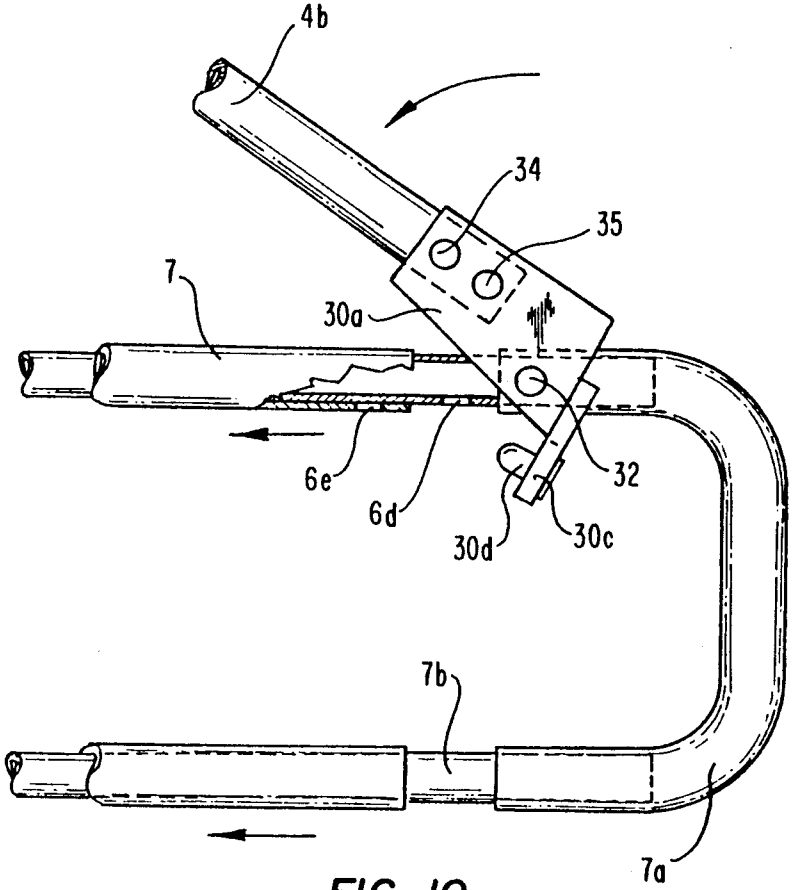
FIG. 10 is the enlarged showing of the fragment of FIG. 9 with the back-frame partially folded over thereby removing the locking boss or detent from engagement with an opening in the upper support member, releasing the same to be telescopically extended.

Each of feet 30*c* and 31*c* has a button or boss, on its upper inner surface when the respective shoe 30, 31 is in upright position, which penetrates and snaps, into the respective superposed openings 6*d*, 6*e*, and corresponding openings on the other side to close the tubular member 6 against 6*c*, and member 7 against 7*c*, thereby maintaining the back support members 4 and 5 in upright position. (See FIGS. 9A and 10)

Figure 3:
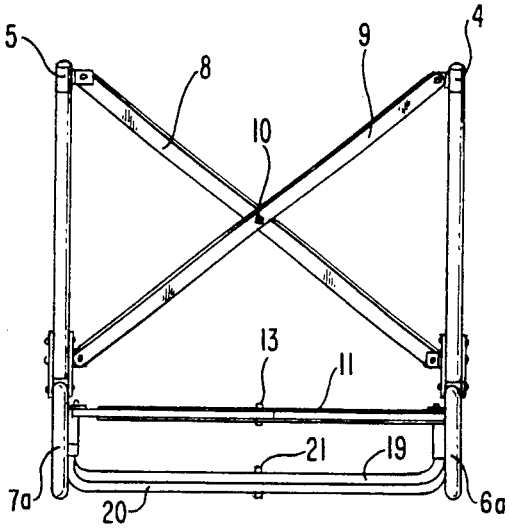
FIG. 3 is a rear elevational showing of the folding chair of my invention, with the fabric removed, showing the frame in open position.

Referring to FIGS. 2 to 5, there is shown the beach chair 1 of the present invention in upright, open position, with the covers 2 and 3 removed to show the framework. As shown in FIG. 3, the back rest is supported by the X-pivoted braces 8 and 9, each comprising a substantially flat rectangular stiffening member of aluminum or other light weight metal, each of which is, for example, $21\frac{1}{8}$ inches long, 1 inch wide, and $\frac{1}{8}$ inch thick in the present embodiment.

The braces 8 and 9 are centrally pivoted on their flat surfaces to move rotatably about the pin 10 to either form a flat x when the chair is completely open, or to collapse together, approaching parallel relation when the chair is closed. The upper end of the brace 8 is connected by a pivot pin to the eyelet 5*d* which is disposed to extend laterally inward from the upper end of the telescoping arm 5. The lower end of brace 8 is connected by a pivot pin in eyelet 4*e*, which extends laterally inward from the lower inner end of the inwardly-slideable tubular member 4*b* which is fixed in position in the shoe 30. Likewise, the upper end of brace 9 is connected by a pivot pin extending from eyelet 4*d*; and the lower end of brace 9 is connected by a pivot pin extending inward from an eyelet 5*e* in a lateral projection from the shoe 31 fixed to the lower end of the sleeve 5*b*.

Figure 4:
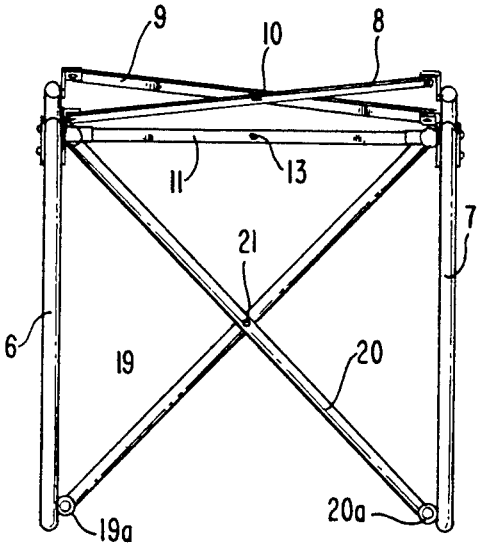
FIG. 4 is a view of the folding chair of my invention from the top, with the fabric removed, showing the frame in open position.
Figure 5:
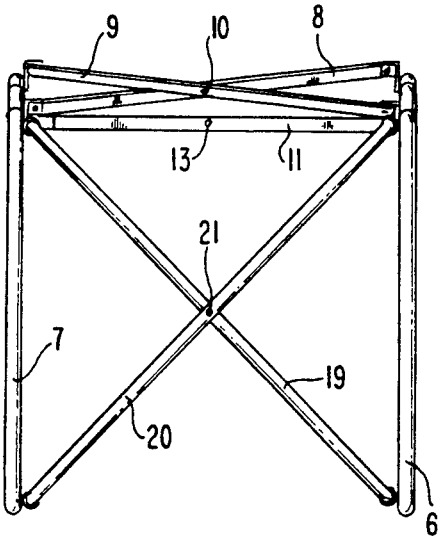
FIG. 5 is a view of the folding chair of my invention from the bottom with the fabric removed, showing the frame in open position.

Referring to FIGS. 4 and 5, there is shown from the top and from the bottom, respectively, with the cover 3 removed, beach chair 1, as fully open and set up. The metal braces 19 and 20 are each one inch wide, and $\frac{1}{8}$ inch thick. When the chair 1 is set up, the braces 19 and 20 are rotatably disposed about the pivot 21 to form an x.

The upper brace 20 terminates at its rear end in an upwardly extending prong about 2 inches long, which is rotatably encased in the cylindrical bearing 19*b* fixed in parallel relation to the inside surface of the support member 6. At its front end, brace 20 terminates in an upwardly extending prong about 2 inches long which is rotatably enclosed in the cylindrical bearing 20*a*, fixed parallel to the inside surface of support member 7.

In a similar manner, the prong on the forward end of the lower brace 19 is rotatably encased in the cylindrical bearing 19*a* attached to the inner surface of support member 6; and the prong on the rear end of brace 19 is encased in the cylindrical bearing 20*b* which is attached to the inner surface of the support member 7*a*.

Figure 8:
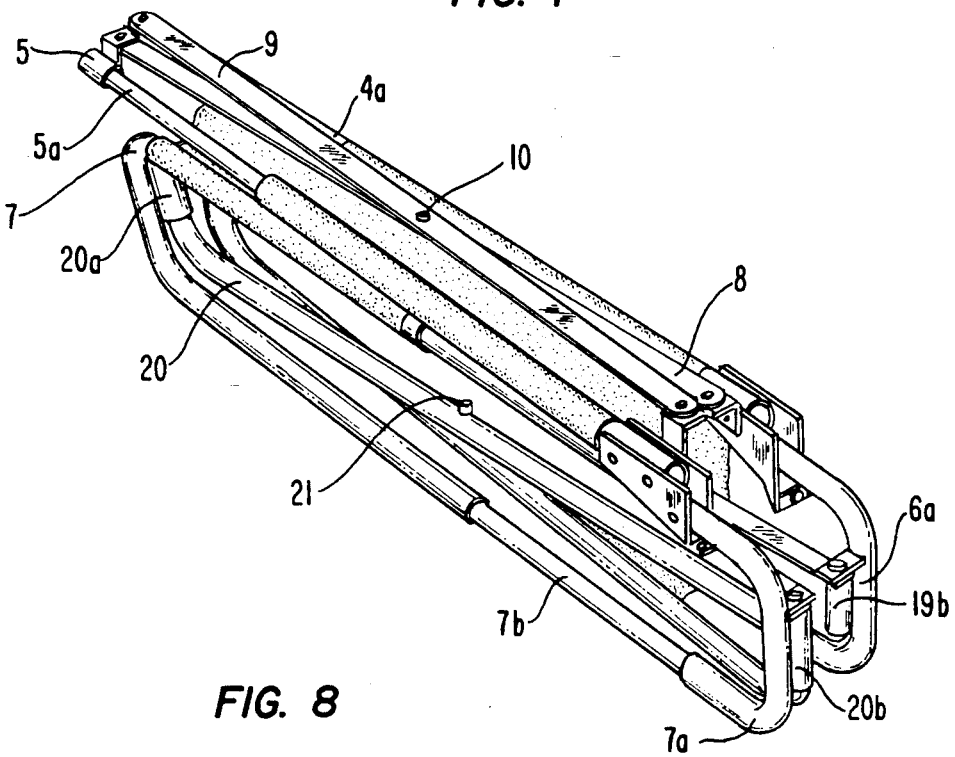
FIG. 8 is a perspective showing of the folding chair of my invention folded up in carrying position.

The mechanism will now be described for folding the chair into a longitudinal compact array, as shown in FIG. 8 of the drawings. The completely folded embodiment is approximately 6 inches in overall width and 22 inches in overall length.

A salient feature of the folding mechanism is the construction of the telescoping tubular back supports 4 and 5, and the telescoping tubular seat supports 6, 6*a* and 7, 7*a*.

Figure 6:
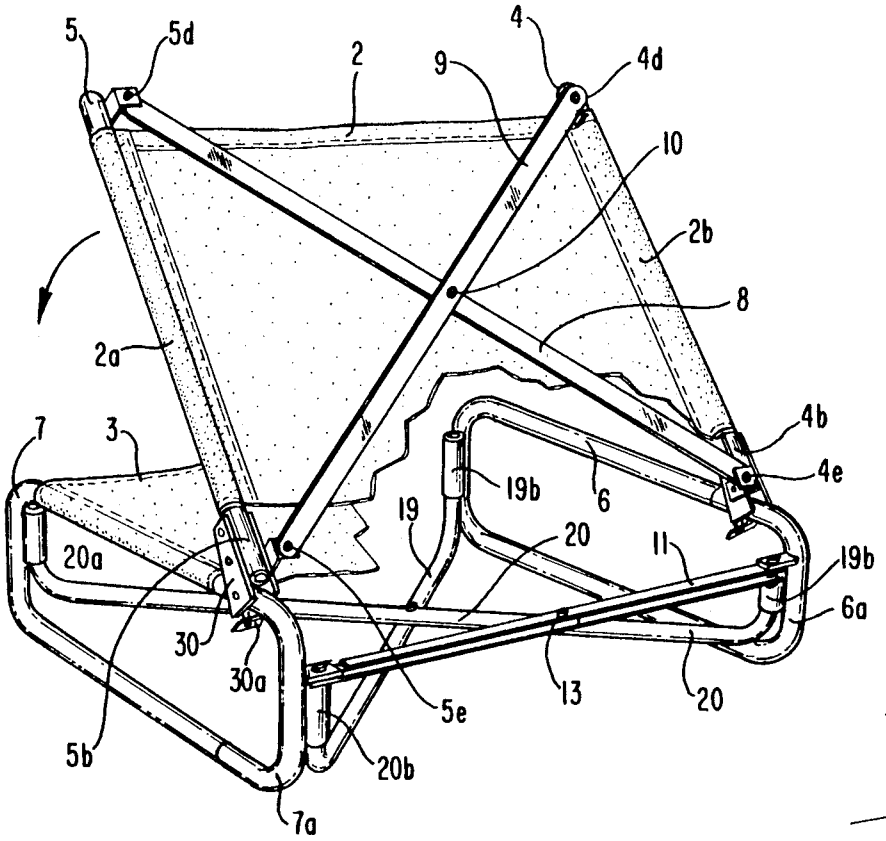

Shown in FIG. 6, is an initial step, which is unique to the combination of the present invention, the boss 30*d*, (see FIGS. 9B and 10) are pulled downward, respectively, disengaging themselves from the openings 6*d*, and the corresponding boss and the corresponding opening on the other side. This unlocks the shoes 30 and 31, permitting them to rotate in a counter clockwise direction about the respective pins 32 and 33 on the other side, thus propelling the back supports 4*b* and 5*b* to rotate forward. This releases the members 6 and 7 to move to the left, becoming separate from the corresponding members 6*a* and 7*a*.

Figure 7:
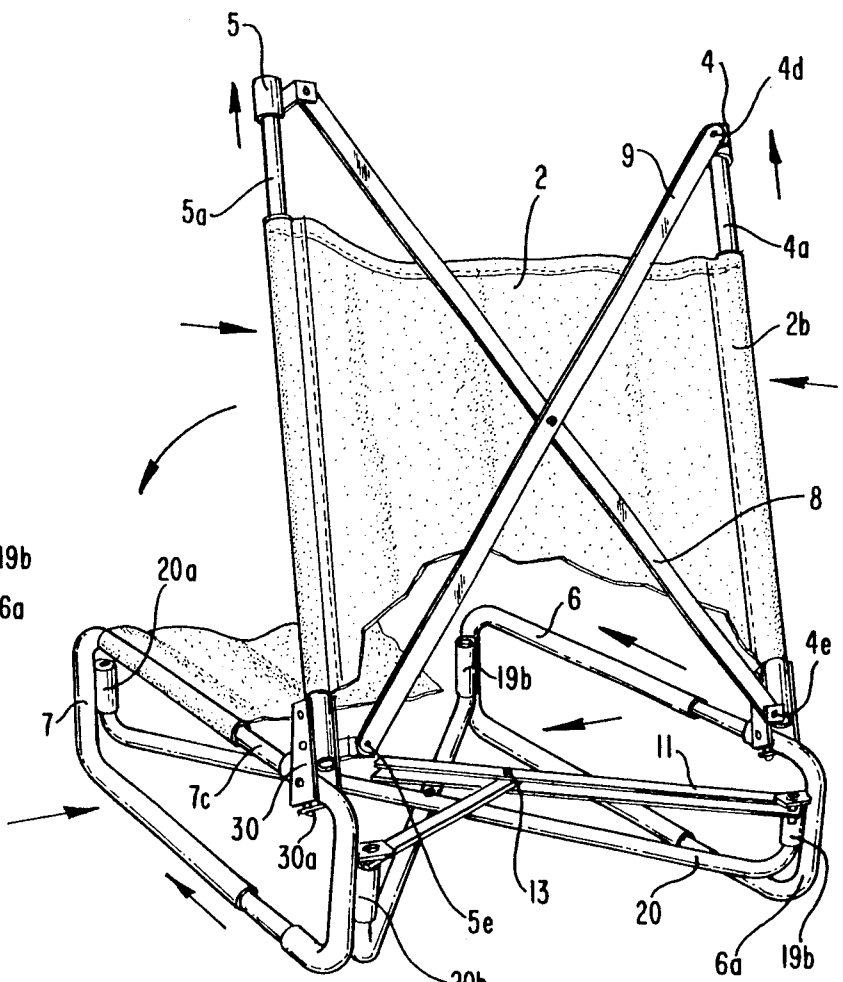
FIGS. 6 and 7 are perspective showings of the chair of my invention with the fabric partially cut away, in the process of being folded up and extended to carrying position.

FIG. 7 shows the next step of the folding-up process, in which the supports 6, 6*a* and 7, 7*a* become telescopically elongated in the direction shown by the arrows, at the same time being moved inwardly, closer together, causing the seat braces 19 and 20 to be rotated towards one another assuming a parallel relation, and the rear cross member 12 to fold into the longitudinal slot in member 11. Simultaneously, the back supports become telescopically elongated with the inner tubular members 4*a* and 5*a* moving outward in the direction shown by the arrows from their respective sleeves 4*b* and 5*b*, causing the back braces 8 and 9 to rotate toward one another assuming a parallel relation. In the final step, the folded chair takes the shape shown in FIG. 8 which for convenience, may be fitted into a tubular bag. This folded configuration is convenient for carrying on a bicycle or motorcycle, or in a car.

Although the invention has been described with reference to a particular embodiment for the purposes of illustration, it will be understood that the invention is not limited to the specific forms or dimensions shown by the way of illustration, but only by the recitations of the claims hereinafter.

What is claimed is:

1. A foldable chair or the like comprising in combination:

a flexible seat rest and a flexible backrest;

means comprising a foldable frame having a plurality of rigid members for supporting said seat rest and said backrest substantially taut and disposed in transversely related planes when said chair is set up in fully open position, and said frame being collapsible in closed relation into an elongated configuration substantially narrower than the width of said seat rest and backrest in said open position;

said frame including a pair of telescoping tubular back members supporting between them the opposite lateral edges of said backrest, said telescoping tubular back-supporting members each comprising a fixed tube and a slidable tube assembled in telescopically coalescing relation;

said backrest being further supported in open position by a first pair of X-pivoted braces pivoted at a point substantially equidistant between their ends, wherein one end of each said first X-pivoted braces is connected to the fixed tube of one of said telescoping tubular back supports and the other end of each of said first X-pivoted braces is connected to the slidable tube of the opposite one of said telescoping tubular supports;

said frame including a pair of rigid lateral seat supporting means, each of said seat supports comprising a pair of telescoping tubular members disposed in substantially parallel relation having a slidable portion and fixed portion hingedly connected to a respective one of the fixed tubes of said telescoping back supports;

said seat rest being further supported in open position by a second pair of X-pivoted braces, pivoted at a point substantially equidistant between their ends, wherein one end of each of said second X-pivoted braces is connected to the fixed tube of one of said telescoping seat supports and the other end of each of said X-pivoted braces is connected to the slidable tube of the oppposite one of said telescoping tubular seat supports;

and locking means comprising a detent constructed to be engaged with said tubular telescoping seat support when said back support is in its upright open position for maintaining said back support upright relative to said telescoping seat support and when said telescoping seat support is in closed shortened position, said detent constructed to disengage and release said telescoping seat support to elongate when said back support is rotated toward said seat support.

2. The combination in accordance with claim 1 wherein said telescoping lateral seat supporting means on each side comprises a fixed C-shaped member having its ends telescopically engaged with the ends of a matching slidable C-shaped member to form an elongated trombone-shaped member of variable length.

3. The combination in accordance with claim 2 wherein said locking means comprises a boss connected to each of the fixed tubes of said back supports adjacent its hinged connection to said seat supports; and wherein each of the slidble portions of said seat supports has an opening which accommodates a respective one of said boss when said locking means is closed.

* * * * *